US006783415B2

(12) United States Patent
Hsu

(10) Patent No.: US 6,783,415 B2
(45) Date of Patent: Aug. 31, 2004

(54) METHOD FOR FORMING RIBS IN A PLASMA DISPLAY PANEL

(75) Inventor: Kuo-Pin Hsu, Kaohsiung Hsien (TW)

(73) Assignee: Au Optronics Corp., Hsinchu (TW)

( * ) Notice: Subject to any disclaimer, the term of this patent is extended or adjusted under 35 U.S.C. 154(b) by 267 days.

(21) Appl. No.: 10/035,545

(22) Filed: Nov. 6, 2001

(65) Prior Publication Data

US 2002/0132550 A1 Sep. 19, 2002

(30) Foreign Application Priority Data

Mar. 14, 2001 (TW) ..... 90105926 A

(51) Int. Cl.[7] ..... H01J 9/24
(52) U.S. Cl. ..... 445/24
(58) Field of Search ..... 445/24; 313/582–587

(56) References Cited

U.S. PATENT DOCUMENTS 6,027,661 A * 2/2000 Ilcisin et al. ..... 216/23
6,368,696 B1 * 4/2002 Asahi et al. ..... 428/195.1

FOREIGN PATENT DOCUMENTS

JP 10-340669 * 12/1998

* cited by examiner

*Primary Examiner*—Joseph Williams
(74) *Attorney, Agent, or Firm*—Ladas & Parry

(57) ABSTRACT

This invention provides a method for forming ribs in a plasma display panel (PDP). The PDP includes a glass substrate, and a plurality of address electrodes are formed on the glass substrate. A dielectric layer is formed above the address electrodes and the glass substrate. A plurality of sandblasting stoppers are formed on the dielectric layer, and the positions of these stoppers are corresponded to that of the address electrodes. The rib material layer is further formed to cover the dielectric layer and the sandblasting stoppers, and then a plurality of sand-resists are patterned on the rib material layer. By using the sand-resists as a mask, a sandblasting process is executed to form a plurality of ribs and expose the sandblasting stoppers. After removing the sand-resists and the sandblasting stoppers, the structures of the ribs are fixed by a sinter process.

10 Claims, 5 Drawing Sheets

METHOD FOR FORMING RIBS IN A PLASMA DISPLAY PANEL

BACKGROUND OF THE INVENTION

1. Field of the Invention

The present invention relates to a plasma display panel (PDP). In particular, the present invention relates to a method for forming ribs in the PDP.

2. Description of the Related Art

Recently, a variety of flat panel displays, such as a liquid crystal display (LCD) and a plasma display panel (PDP) have been intensively developed to replace cathode ray tube (CRT) displays. In PDP technololgy, an ultraviolet light is emitted to excite the RBG phosphors for producing visible lights. The advantages of the PDP include a large display area, wide viewing angle, and intense brightness.

Usually, a PDP includes a front plate and a rear plate, the rear plate is spaced a distance to the front plate and sealed with the front plate. A plurality of barrier ribs are formed in parallel on the rear plate of the PDP. These barrier ribs are used to define a plurality of discharge spaces, and prevent discharge coupling and color cross-talk between adjacent cells. The traditional method for forming the ribs is described hereafter with FIGS. 1A and 1B.

As shown in FIG. 1A, the address electrodes 12 are formed on the rear glass substrate 10. The dielectric layer 14 is further formed to cover the address electrodes 12. The rib material layer 18 is formed above the dielectric layer 14. The photoresist dry film is laminated on the rib material layer 18. After an exposure and development process, the photoresist dry film 20 is patterned as shown in FIG. 1A.

Referring to 1B, the photoresist dry film 20 is used as a mask in a sandblasting process, and the rib material layer 18 is patterned by the sandblasting process to form the ribs 18*a*.

In the above-mentioned conventional method, the dielectric layer 14 under the rib material layer 18 can protect the address electrodes 12 from damaging in the sandblasting process. However, a high temperature sintering process is required after the dielectric layer 14 is printed on the substrate 10. The sintering step will lengthen the manufacturing time and affect the yield of the PDP. In addition, the height of the ribs 18*a* is about 100–200 μm, so the sandblasting time is too long to keep the uniformity of the ribs 18*a*. Therefore, the discharging efficiency is decreased when these ribs lack uniform bottom width and the profile. A method for forming ribs of a plasma display panel is needed to solve the above-mentioned problems.

SUMMARY OF THE INVENTION

The present invention provides a method for fabricating ribs of a PDP, in which the top width, the bottom width, and the profile of the ribs can be effectively controlled, and a thermal step can be saved.

The present invention provides a method for forming ribs in a plasma display panel (PDP). The PDP includes a glass substrate, and a plurality of address electrodes are formed on the glass substrate. A dielectric layer is formed above the address electrodes and the glass substrate. A plurality of sandblasting stoppers are formed on the dielectric layer, and the positions of these stoppers are corresponded to that of the address electrodes. The rib material layer is further formed to cover the dielectric layer and the sandblasting stoppers, and then a plurality of sand-resists are patterned on the rib material layer. By using the sand-resists as a mask, a sandblasting process is executed to form a plurality of ribs and expose the sandblasting stoppers. After removing the sand-resists and the sandblasting stoppers, the structures of the ribs are fixed by a sinter process.

BRIEF DESCRIPTION OF THE DRAWINGS

The present invention will become more fully understood from the detailed description given herein and the accompanying drawings, given by way of illustration only and thus not intended to be limitative of the present invention.

DETAILED DESCRIPTION OF THE PREFERRED EMBODIMENT

A detail description of the method for forming the ribs in the PDP of the present invention is given hereafter with reference to FIGS. 2A–2G.

Figure 1A:
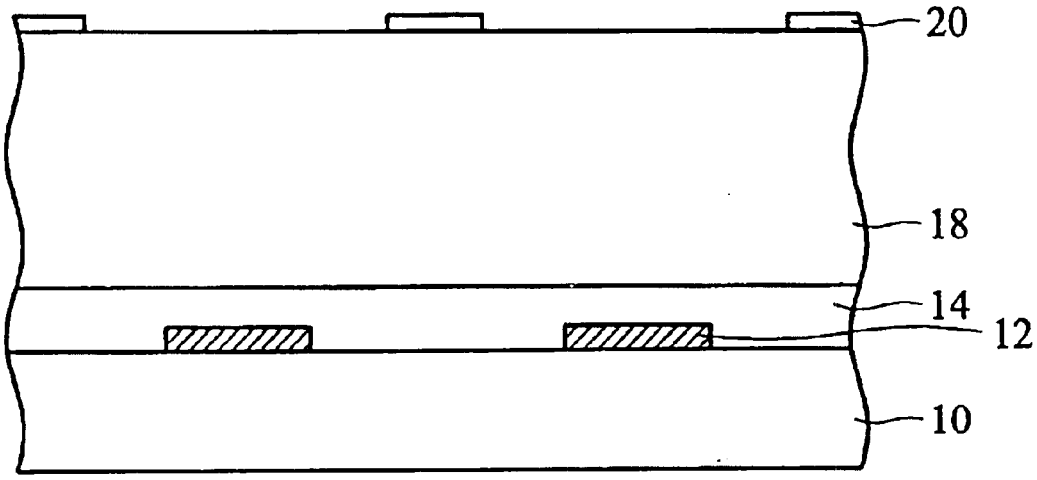
FIG. 1A ( PRIOR ART )
FIGS. 1A–1B show the method for fabricating ribs of the prior PDP.
Figure 1B:
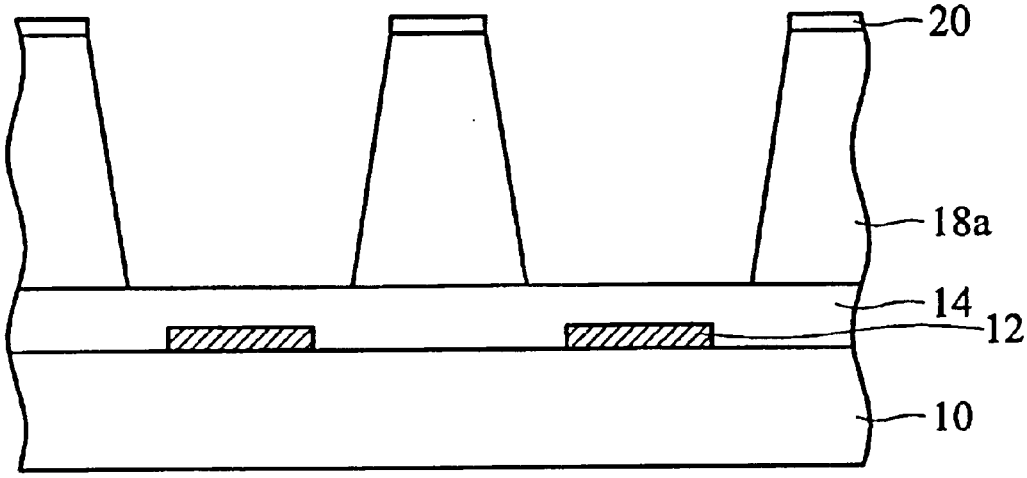
FIG. 1B ( PRIOR ART )
Figure 2A:
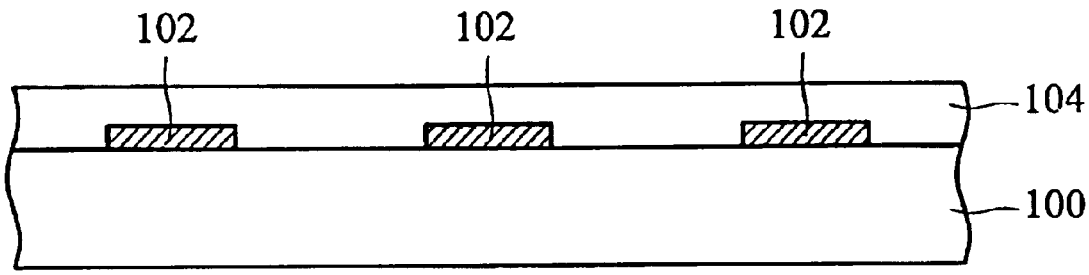
FIGS. 2A–2G are the method for forming the ribs of the PDP according to the present invention.

Referring to FIG. 2A, the address electrodes 102 are formed on the glass substrate 100. The dielectric layer 104 can cover and protect the address electrodes 102. The dielectric layer 104 can be formed by screen-printing. Note that the dielectric layer 104 is not strengthened by a sinter process.

Figure 2B:
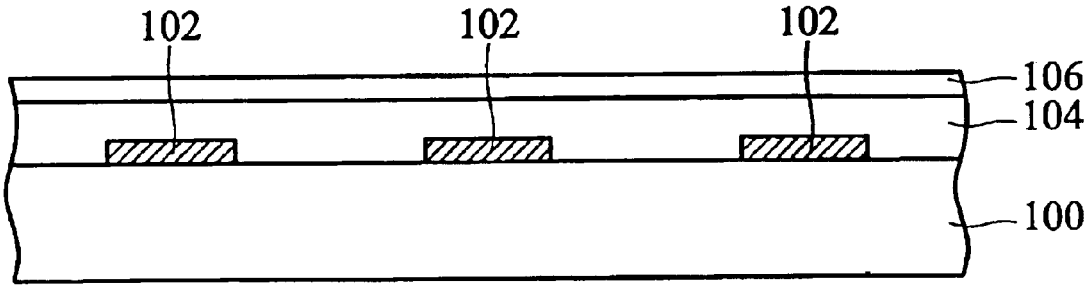

As shown in FIG. 2B, the photosensitive dry film 106 is formed on the dielectric layer 104. The photosensitive dry film 106 is formed as thin as possible, and the thickness of the photosensitive dry film 106 is preferably about 5~30 μm. The photosensitive dry film 106 can be negative type photoresist and formed by laminating.

Figure 2C:
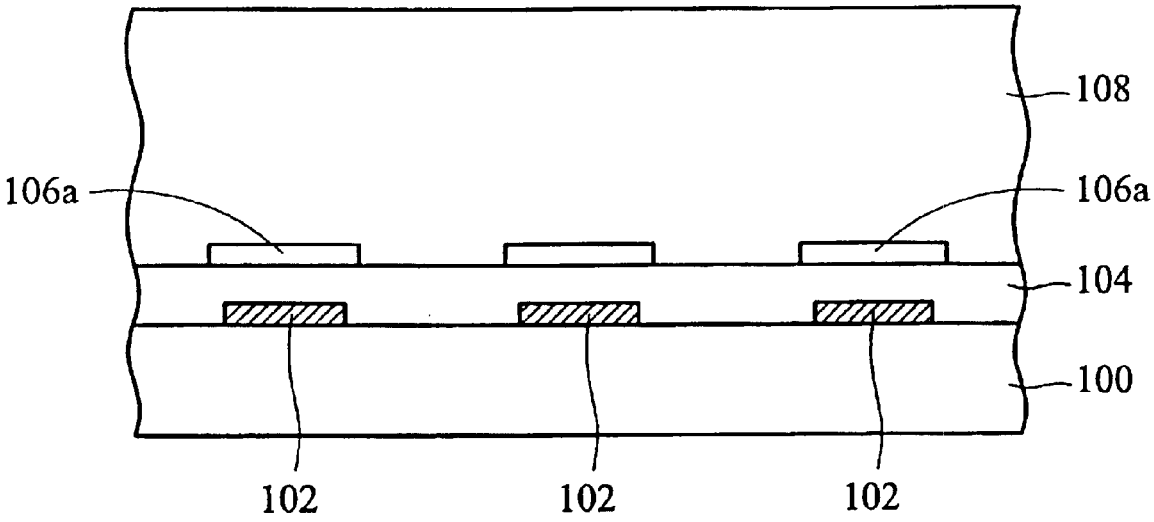

Referring to FIG. 2C, the photosensitive dry film 106 is patterned to form the sandblasting stoppers 106*a*. The positions of these sandblasting stoppers 106*a* may be corresponded to that of the address electrodes 102. The underlying dielectric layer 104 has not been sintered at this moment, so the structure of the dielectric layer 104 is not rigid enough. In addition, the width of each sandblasting stoppers 106*a* should be not smaller than that of the underlying address electrode 102 so as to protect the address electrodes 102 and the unsintering dielectric layer 104 during the following sandblasting step. Furthermore, the interval between two sandblasting stoppers 106*a* is substantially equal to the bottom width of each rib which is formed by the subsequent process.

A rib material layer 108 is formed above the dielectric layer 104 and the sandblasting stoppers 106*a*. The thickness of the rib material layer 108 is about 100~200 μm.

Figure 2D:
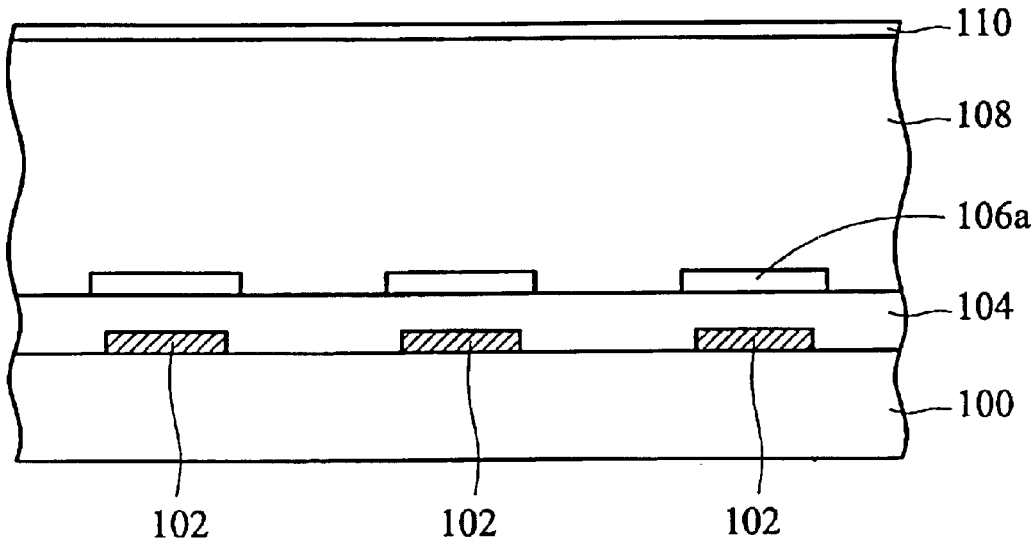

As shown in FIG. 2D, another photosensitive dry film 110 is formed on the rib material layer 108. The thickness of the photosensitive dry film 110 is about 30~100 μm.

Figure 2E:
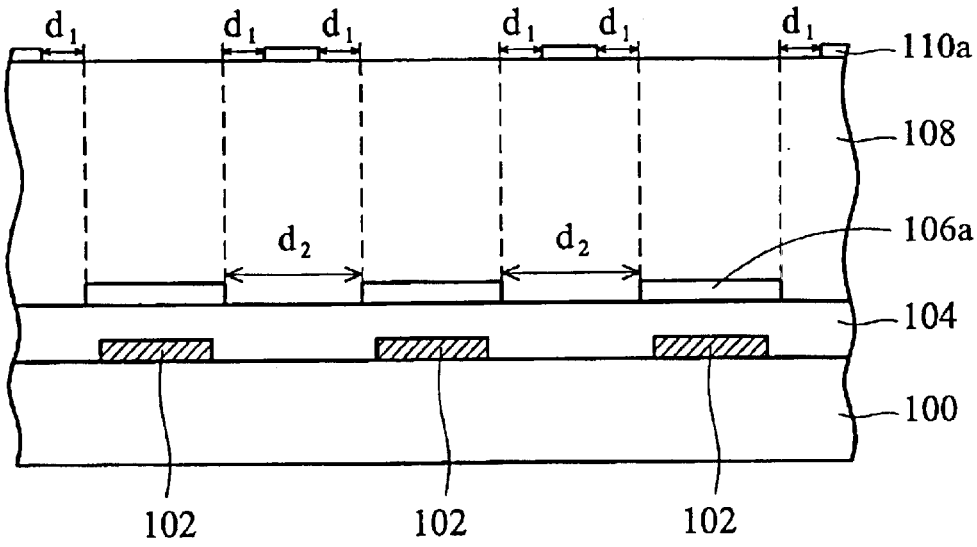

As shown in FIG. 2E, the photosensitive dry film 110 is patterned to form a plurality of sand-resists 110*a*. The sand-resists 110*a* and the sandblasting stoppers 106*a* are formed in an interlaced configuration. That is, each sand-resist 10*a* is disposed between two sandblasting stoppers 106*a*.

In this embodiment, as shown in FIG. 2E, a horizontal distance $d_1$ is defined between one side of one sand-resist 11*a* and the adjacent sandblasting stopper 106*a*. The distance between the other side of the sand-resist 110*a* and another adjacent sandblasting stopper 106*a* is also equal $d_1$. The horizontal distance $d_1$ is not less than zero. The gap between two neighbor sandblasting stoppers is defined as $d_2$.

Figure 2F:
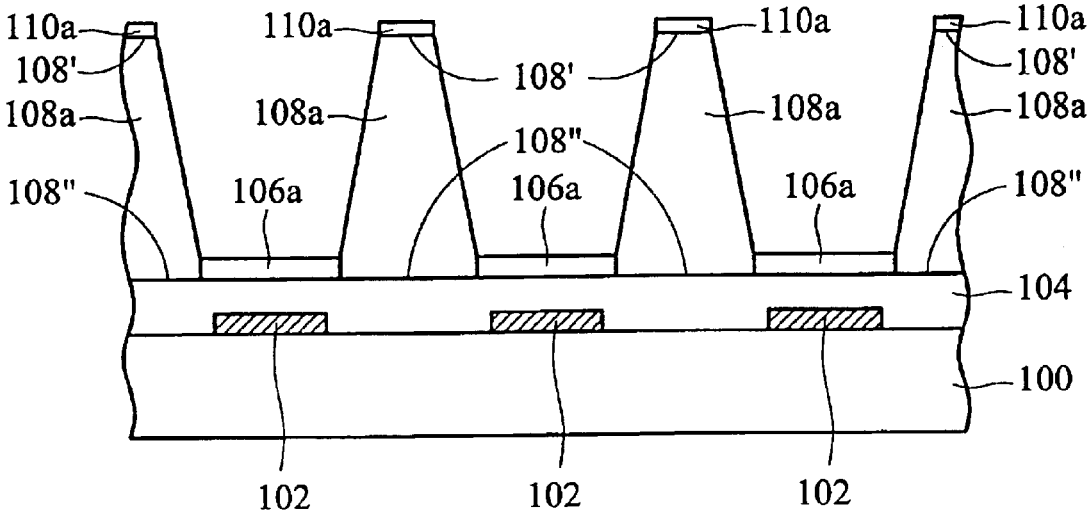

With reference to FIG. 2F, by using the sand-resists 110*a* as a mask, a sandblasting process is conducted to removed parts of the rib material layer 108 uncovered by the sand-resists 110*a* to form the ribs 108*a* and expose the sandblasting stoppers 106*a*. Moreover, the bottom width 108' of each rib 108*a* is substantially equal to the gap $d_2$ between two nearby sandblasting stoppers 106*a*.

Figure 2G:
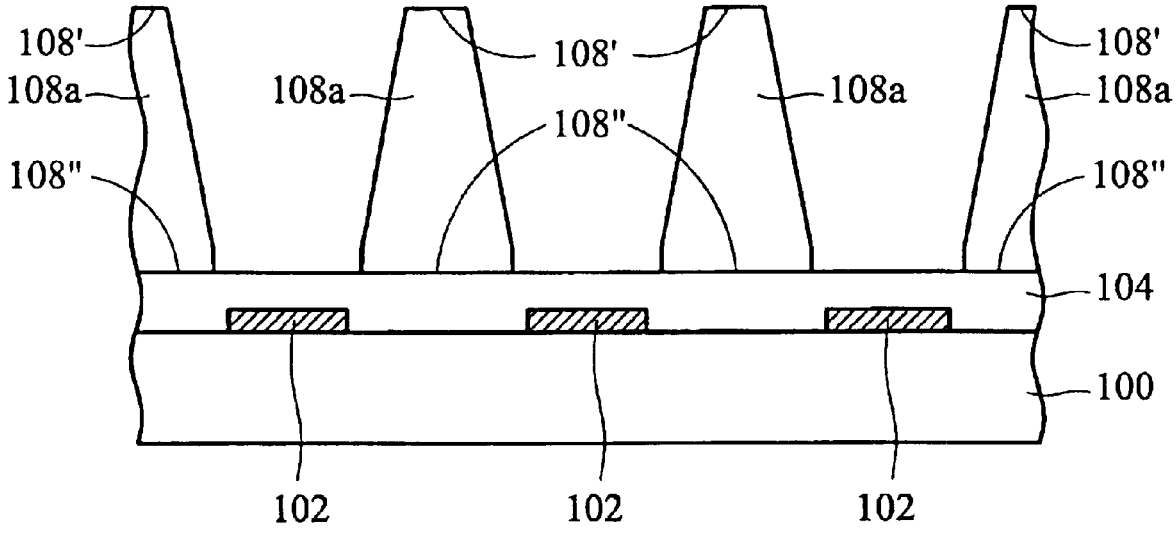

Referring to FIG. 2G, the sandblasting stoppers 106*a* and the sand-resists 110*a* are peeled off. Next, these ribs 108*a* and the dielectric layer 104 are sintered at the same time to strengthen their structures. The manufacturing process of the rear panel is completed. Because the ribs 108*a* and the dielectric layer 104 are sintered at the same time by the same process, the time of the sintering process can be reduced, resulting in decreasing the production cost and improving the performance of the PDP.

It should be noted that the bottom width 108" of each rib 108*a* is related to the gap $d_2$ between two sandblasting stoppers 106*a*, and the top width 108' of each rib 108*a* depends on the interval between two sand-resists 110*a*. Therefore, the bottom width 108" and the top width 108' of each rib 108*a* can be adjusted by the intervals of the sandblasting stoppers and the sand-resists according to the demands of the PDP. The shape of each rib 108*a* is also varied. The ribs 108*a* are shaped according to the shapes of the sandblasting stoppers 106*a* and the sand-resists 110*a*.

Figure 3:
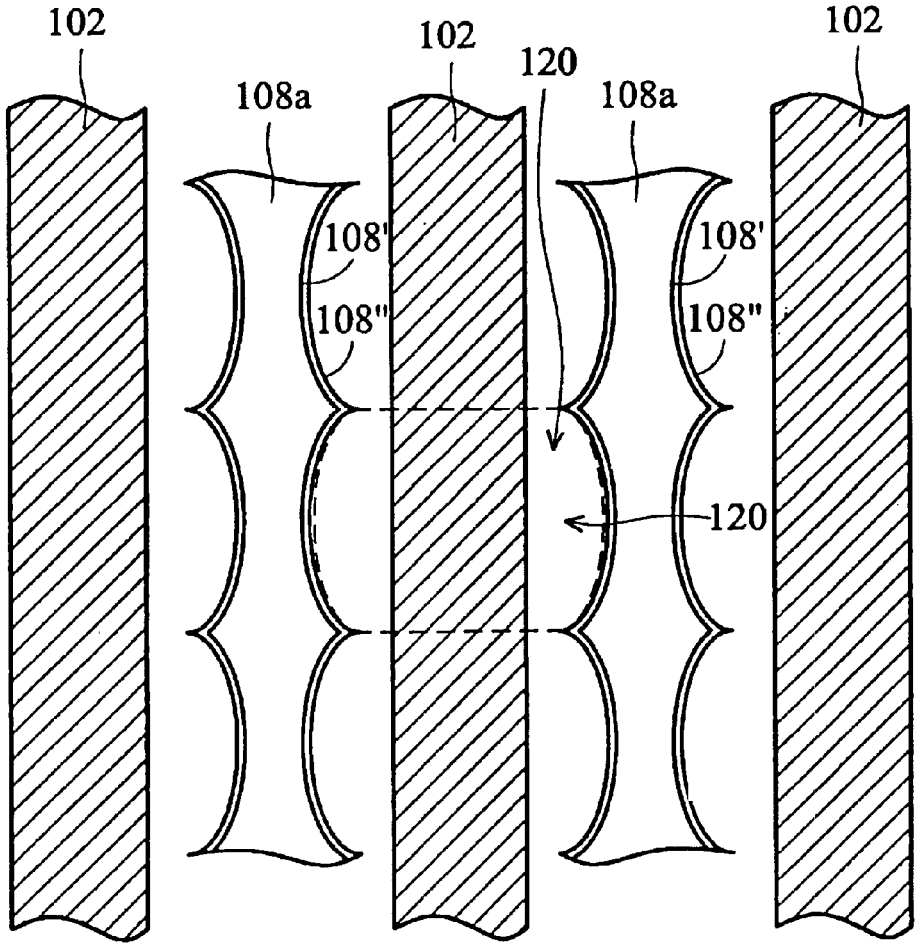
FIG. 3 shows another structure of the rib in the present invention.

As shown in FIG. 3, each rib 108*a* has a curved sidewall. In such an example, when the dimension of the glass substrate 100 is fixed, the width of each sandblasting stopper is enlarged in order to reduce the width of each rib 108*a*. Therefore, the discharging space of each discharging cell 120 is increased, thus the luminescence efficiency is enhanced. The brightness of the PDP is further improved and the electric power is saved.

The ribs 108*a* can also be shaped as traditional straight sidewalls.

According to the present invention, the ribs and the dielectric layer above the address electrodes are sintered at the same time. One sinter step for only sintering the dielectric layer is reduced, resulting in decreasing the cost and improving the performance of the PDP.

Further, the ribs can be shaped by different widths of each sandblasting stopper and each sand-resist. The bottom widths and the profiles of these ribs can be unified by these sandblasting stoppers and the sand-resists. Moreover, the discharging space of each discharging cell can be increased by narrower ribs. Therefore, it enhances the brightness of the PDP and saves electric power without sacrificing the stability of the ribs. Thus, the space of each discharging cell is enlarged and these discharging cells have better uniformity.

While the present invention is described by preferred embodiments, it should be understood that the invention is not limited to these embodiments in any way. On the contrary, it is intended to cover all the modifications and arrangements as they would be apparent to those skilled in the art. Therefore, the scope of the appended claims should be interpreted in the broadest sense so as to encompass all the modifications and arrangements.

What is claimed is:

1. A method for forming ribs in a plasma display panel (PDP), comprising:

providing a glass substrate;

forming a plurality of address electrodes on the glass substrate;

forming a dielectric layer on the address electrodes and the glass substrate;

forming and patterning a plurality of sandblasting stoppers above the dielectric layer, the sandblasting stoppers substantially corresponding to the address electrodes, and the width of each sandblasting stopper being not smaller than the width of each address electrode;

forming a rib material layer over the dielectric layer and the sandblasting stoppers;

forming and patterning a plurality of sand-resists on the rib material layer;

sandblasting the rib material layer to form a plurality of ribs and to expose the sandblasting stoppers;

removing the sand-resists and the sandblasting stoppers; and performing a sinter process to the dielectric layer and the ribs.

2. The method as claimed in claim 1, wherein the method of forming the sandblasting stopper comprises the steps of:

(a) forming a first photosensitive layer onto the dielectric layer; and (b) patterning the first photosensitive layer by an exposure and development process to form the sandblasting stoppers.

3. The method as claimed in claim 2, wherein the first photosensitive layer is a photosensitive dry film, and the dry film is laminated on the dielectric layer.

4. The method as claimed in claim 1, wherein the method of forming the sand-resists comprises the steps of:

(a) forming a second photosensitive layer on the dielectric layer; and (b) patterning the second photosensitive layer by an exposure and development process to form the sand-resists.

5. The method as claimed in claim 4, wherein the second photosensitive layer is a photosensitive dry film, and the dry film is laminated on the dielectric layer.

6. The method as claimed in claim 1, wherein the sandblasting stoppers have a predetermined horizontal distance to the sand-resists.

7. The method as claimed in claim 1, wherein a gap is formed between two adjacent sandblasting stoppers, each rib has a bottom width, and the gap is substantially equal to the bottom width of the rib.

8. The method as claimed in claim 1, wherein the width of each sand-resist is substantially equal to a top width of each rib.

9. The method as claimed in claim 1, wherein the sidewalls of the ribs are in a striped shape.

10. The method as claimed in claim 1, wherein the sidewalls of the ribs are in a curved shape.

* * * * *